US008568279B2

(12) United States Patent
Golesh

(10) Patent No.: US 8,568,279 B2
(45) Date of Patent: Oct. 29, 2013

(54) ENGAGEMENT INTERFACE FOR AN EXERCISE MACHINE

(75) Inventor: Eric D. Golesh, Arvada, CO (US)

(73) Assignee: Nautilus, Inc., Vancouver, WA (US)

( * ) Notice: Subject to any disclaimer, the term of this patent is extended or adjusted under 35 U.S.C. 154(b) by 328 days.

(21) Appl. No.: 13/076,876

(22) Filed: Mar. 31, 2011

(65) Prior Publication Data

US 2011/0319234 A1 Dec. 29, 2011

Related U.S. Application Data

(60) Provisional application No. 61/319,567, filed on Mar. 31, 2010.

(51) Int. Cl.
*A63B 21/00* (2006.01)

(52) U.S. Cl.
USPC ..... 482/104; 482/92; 482/93

(58) Field of Classification Search
USPC ..... 482/92, 93, 94, 104, 107
See application file for complete search history.

(56) References Cited

U.S. PATENT DOCUMENTS

| | | | |
|---|---|---|---|
| 2,855,199 | A | 10/1958 | Noland et al. |
| 2,921,791 | A | 1/1960 | Berne |
| 3,306,611 | A | 2/1967 | Gaul |
| 3,588,101 | A | 6/1971 | Jungreis |
| 3,638,941 | A | 2/1972 | Kulkens |
| 3,662,602 | A | 5/1972 | Weiss |
| 3,822,599 | A | 7/1974 | Brentham |
| 3,856,297 | A | 12/1974 | Schnell |
| 4,076,236 | A | 2/1978 | Ionel |
| 4,290,597 | A | 9/1981 | Schleffendorf |
| 4,336,934 | A | 6/1982 | Hanagan et al. |
| 4,357,010 | A | 11/1982 | Telle |
| RE31,113 | E | 12/1982 | Coker et al. |
| 4,405,128 | A | 9/1983 | Mclaughlin et al. |
| 4,426,077 | A | 1/1984 | Becker |
| 4,453,710 | A | 6/1984 | Plötz |

(Continued)

FOREIGN PATENT DOCUMENTS

| | | | |
|---|---|---|---|
| CN | 2430184 | Y | 5/2001 |
| EP | 0121902 | A1 | 10/1984 |

(Continued)

OTHER PUBLICATIONS

Cybex International, Inc., Commercial Strength Systems brochure, 4535 Arm Curl, 5255 Rear Delt, 5281 Arm Curl, Apr. 2000, pp. 9 and 36.

(Continued)

*Primary Examiner* — Jerome W Donnelly
(74) *Attorney, Agent, or Firm* — Dorsey & Whitney LLP

(57) ABSTRACT

An engagement interface for an exercise machine for selectively engaging a carriage with one or more resisting elements may include one or more engagement devices arranged on the carriage. An engagement device may include a reaching or first portion and a flange or second portion. An engagement feature may be positioned on the one or more resisting elements and configured for engagement by at least one of the one or more engagement devices. The engagement feature may include a body, at least one wall extending generally perpendicular to the body, a first tab extending from the at least one wall in a first direction, and a second tab extending from the at least one wall in a second direction opposite the first direction. The first and second tabs may be configured for engagement by at least a portion of an engagement device.

20 Claims, 10 Drawing Sheets

(56) References Cited

U.S. PATENT DOCUMENTS

| | | | |
|---|---|---|---|
| 4,478,411 | A | 10/1984 | Baldwin |
| 4,502,681 | A | 3/1985 | Blomqvist |
| 4,529,197 | A | 7/1985 | Gogarty |
| 4,529,198 | A | 7/1985 | Hettick, Jr. |
| 4,538,805 | A | 9/1985 | Parviainen |
| 4,546,971 | A | 10/1985 | Raasoch |
| 4,598,908 | A | 7/1986 | Morgan |
| 4,627,614 | A | 12/1986 | de Angeli |
| 4,627,615 | A | 12/1986 | Nurkowski |
| 4,700,944 | A | 10/1987 | Sterba et al. |
| 4,722,522 | A | 2/1988 | Lundgren |
| 4,756,526 | A | 7/1988 | Broussard |
| 4,787,629 | A | 11/1988 | DeMyer |
| 4,804,179 | A | 2/1989 | Murphy et al. |
| 4,822,034 | A | 4/1989 | Shields |
| 4,834,396 | A | 5/1989 | Schnell |
| 4,854,578 | A | 8/1989 | Fulks |
| 4,858,915 | A | 8/1989 | Szabo |
| 4,861,025 | A | 8/1989 | Rockwell |
| 4,880,229 | A | 11/1989 | Broussard |
| 4,902,007 | A | 2/1990 | Ferrari |
| 4,944,511 | A | 7/1990 | Francis |
| 4,951,939 | A | 8/1990 | Peters |
| 4,971,305 | A | 11/1990 | Rennex |
| 4,982,957 | A | 1/1991 | Shields |
| 5,002,271 | A | 3/1991 | Gonzales |
| 5,050,873 | A | 9/1991 | Jones |
| D321,025 | S | 10/1991 | Jones |
| D321,026 | S | 10/1991 | Jones |
| D321,027 | S | 10/1991 | Jones |
| D321,028 | S | 10/1991 | Jones |
| 5,060,938 | A | 10/1991 | Hawley, Jr. |
| D321,387 | S | 11/1991 | Jones |
| D321,389 | S | 11/1991 | Jones |
| D321,390 | S | 11/1991 | Jones |
| D321,391 | S | 11/1991 | Jones |
| 5,066,003 | A | 11/1991 | Jones |
| 5,066,004 | A | 11/1991 | Jones |
| 5,094,450 | A | 3/1992 | Stearns |
| 5,106,080 | A | 4/1992 | Jones |
| 5,116,297 | A | 5/1992 | Stonecipher |
| 5,123,885 | A | 6/1992 | Shields |
| 5,125,881 | A | 6/1992 | Jones |
| 5,135,449 | A | 8/1992 | Jones |
| 5,135,456 | A | 8/1992 | Jones |
| 5,171,198 | A | 12/1992 | Jones |
| 5,180,354 | A | 1/1993 | Jones |
| 5,181,896 | A | 1/1993 | Jones |
| 5,201,694 | A | 4/1993 | Zappel |
| 5,217,422 | A | 6/1993 | Domzalski |
| 5,230,680 | A | 7/1993 | Wu |
| 5,263,915 | A | 11/1993 | Habing |
| 5,273,504 | A | 12/1993 | Jones |
| 5,273,505 | A | 12/1993 | Jones |
| 5,306,221 | A | 4/1994 | Itaru |
| 5,308,303 | A | 5/1994 | Rawls et al. |
| 5,336,148 | A | 8/1994 | Ish, III |
| 5,380,258 | A | 1/1995 | Hawley, Jr. |
| 5,387,170 | A | 2/1995 | Rawls et al. |
| D359,778 | S | 6/1995 | Towley, III et al. |
| 5,429,570 | A | 7/1995 | Beyer |
| 5,484,367 | A | 1/1996 | Martinez |
| 5,554,084 | A | 9/1996 | Jones |
| 5,554,089 | A | 9/1996 | Jones |
| 5,554,090 | A | 9/1996 | Jones |
| 5,562,577 | A | 10/1996 | Nichols, Sr. et al. |
| 5,569,139 | A | 10/1996 | Civie et al. |
| 5,628,715 | A | 5/1997 | Simonson |
| 5,632,710 | A | 5/1997 | England et al. |
| 5,637,064 | A | 6/1997 | Olson et al. |
| 5,749,813 | A | 5/1998 | Domzalski |
| 5,769,757 | A | 6/1998 | Fulks |
| 5,769,762 | A | 6/1998 | Towley, III et al. |
| 5,779,604 | A | 7/1998 | Towley, III et al. |
| 5,788,615 | A | 8/1998 | Jones |
| 5,788,616 | A | 8/1998 | Polidi |
| 5,810,701 | A | 9/1998 | Ellis et al. |
| 5,839,997 | A | 11/1998 | Roth et al. |
| 5,876,313 | A | 3/1999 | Krull |
| 5,971,899 | A | 10/1999 | Towley, III et al. |
| 6,015,367 | A | 1/2000 | Scaramucci |
| 6,033,350 | A | 3/2000 | Krull |
| D422,654 | S | 4/2000 | Chen |
| 6,045,491 | A | 4/2000 | McNergney et al. |
| 6,083,144 | A | 7/2000 | Towley, III et al. |
| 6,095,955 | A | 8/2000 | Lee |
| 6,099,442 | A | 8/2000 | Krull |
| 6,117,049 | A | 9/2000 | Lowe |
| 6,149,558 | A | 11/2000 | Chen |
| 6,174,265 | B1 | 1/2001 | Alessandri |
| 6,186,927 | B1 | 2/2001 | Krull |
| 6,186,928 | B1 | 2/2001 | Chen |
| 6,196,952 | B1 | 3/2001 | Chen |
| 6,203,474 | B1 | 3/2001 | Jones |
| 6,228,003 | B1 | 5/2001 | Hald et al. |
| 6,261,022 | B1 | 7/2001 | Dalebout et al. |
| 6,322,481 | B1 | 11/2001 | Krull |
| 6,350,221 | B1 | 2/2002 | Krull |
| 6,364,815 | B1 | 4/2002 | Lapcevic |
| 6,402,666 | B2 | 6/2002 | Krull |
| 6,416,446 | B1 | 7/2002 | Krull |
| 6,422,979 | B1 | 7/2002 | Krull |
| 6,436,013 | B1 | 8/2002 | Krull |
| 6,440,044 | B1 | 8/2002 | Francis et al. |
| 6,443,874 | B1 | 9/2002 | Bennett |
| 6,482,139 | B1 | 11/2002 | Haag |
| 6,500,101 | B1 | 12/2002 | Chen |
| 6,500,106 | B1 | 12/2002 | Fulks |
| 6,517,468 | B1 | 2/2003 | Lapcevic |
| 6,540,650 | B1 | 4/2003 | Krull |
| 6,561,960 | B2 | 5/2003 | Webber |
| 6,595,902 | B1 | 7/2003 | Savage et al. |
| 6,605,024 | B2 | 8/2003 | Stearns |
| 6,629,910 | B1 | 10/2003 | Krull |
| 6,656,093 | B2 | 12/2003 | Chen |
| 6,669,606 | B2 | 12/2003 | Krull |
| 6,679,816 | B1 | 1/2004 | Krull |
| 6,682,464 | B2 | 1/2004 | Shifferaw |
| 6,719,672 | B1 | 4/2004 | Ellis et al. |
| 6,719,674 | B2 | 4/2004 | Krull |
| 6,733,424 | B2 | 5/2004 | Krull |
| 6,746,381 | B2 | 6/2004 | Krull |
| 6,749,547 | B2 | 6/2004 | Krull |
| 6,802,800 | B1 | 10/2004 | Hobson |
| D498,272 | S | 11/2004 | Sanford-Schwentke et al. |
| D500,820 | S | 1/2005 | Krull |
| 6,855,097 | B2 | 2/2005 | Krull |
| 6,872,173 | B2 | 3/2005 | Krull |
| 6,902,516 | B2 | 6/2005 | Krull |
| D508,628 | S | 8/2005 | Crawford et al. |
| 6,974,405 | B2 | 12/2005 | Krull |
| 7,018,325 | B2 | 3/2006 | Shifferaw |
| D521,087 | S | 5/2006 | Francis |
| 7,066,867 | B2 | 6/2006 | Krull |
| 7,077,790 | B1 | 7/2006 | Krull |
| 7,077,791 | B2 | 7/2006 | Krull |
| 7,083,554 | B1 | 8/2006 | Lo Presti |
| 7,090,625 | B2 | 8/2006 | Chermack |
| D528,173 | S | 9/2006 | Flick et al. |
| D528,611 | S | 9/2006 | Flick |
| 7,112,163 | B2 | 9/2006 | Krull |
| 7,121,988 | B2 | 10/2006 | Walkerdine |
| 7,137,931 | B2 | 11/2006 | Liu |
| 7,137,932 | B2 | 11/2006 | Doudiet |
| D533,910 | S | 12/2006 | Dibble et al. |
| 7,153,243 | B1 | 12/2006 | Krull |
| D536,752 | S | 2/2007 | Walkerdine |
| 7,172,536 | B2 | 2/2007 | Liu |
| 7,182,715 | B2 | 2/2007 | Anderson |
| 7,189,190 | B2 | 3/2007 | Lamar et al. |
| D540,405 | S | 4/2007 | Crawford et al. |
| D540,894 | S | 4/2007 | Crawford et al. |
| 7,201,711 | B2 | 4/2007 | Towley, III et al. |
| 7,223,214 | B2 | 5/2007 | Chen |

(56) References Cited

U.S. PATENT DOCUMENTS

| | | | |
|---|---|---|---|
| 7,229,391 | B2 | 6/2007 | Francis |
| 7,252,627 | B2 | 8/2007 | Carter |
| 7,261,678 | B2 | 8/2007 | Crawford et al. |
| D550,789 | S | 9/2007 | Dibble et al. |
| 7,285,078 | B1 | 10/2007 | Liu |
| 7,291,098 | B1 | 11/2007 | Krull |
| 7,306,549 | B2 | 12/2007 | Francis |
| 7,367,927 | B2 | 5/2008 | Krull |
| 7,377,885 | B2 | 5/2008 | Doudiet |
| 7,387,595 | B2 | 6/2008 | Towley, III et al. |
| 7,387,597 | B2 | 6/2008 | Krull |
| 7,413,532 | B1 | 8/2008 | Monsrud et al. |
| 7,413,533 | B2 | 8/2008 | Lin |
| 7,429,235 | B2 | 9/2008 | Lin |
| 7,452,312 | B2 | 11/2008 | Liu |
| 7,485,077 | B2 | 2/2009 | Chen |
| 7,507,189 | B2 | 3/2009 | Krull |
| 7,534,199 | B2 | 5/2009 | Krull |
| 7,540,832 | B2 | 6/2009 | Krull |
| 7,553,265 | B2 | 6/2009 | Crawford et al. |
| 7,591,770 | B2 | 9/2009 | Stewart et al. |
| 7,614,982 | B2 | 11/2009 | Crawford et al. |
| 7,625,322 | B1 | 12/2009 | Krull |
| 7,662,074 | B2 | 2/2010 | Webb |
| 7,736,283 | B2 | 6/2010 | Webb |
| 7,740,568 | B2 | 6/2010 | Webb |
| 7,758,478 | B2 | 7/2010 | Golesh et al. |
| 7,794,373 | B2 | 9/2010 | Crawford et al. |
| 7,887,468 | B2 | 2/2011 | Ross et al. |
| 8,002,680 | B2 | 8/2011 | Crawford et al. |
| 8,016,729 | B2 | 9/2011 | Webb |
| 2002/0025888 | A1 | 2/2002 | Germanton et al. |
| 2002/0077230 | A1 | 6/2002 | Lull et al. |
| 2003/0027697 | A1 | 2/2003 | Baumler |
| 2003/0092542 | A1 | 5/2003 | Bartholomew et al. |
| 2003/0148862 | A1 | 8/2003 | Chen et al. |
| 2003/0199368 | A1 | 10/2003 | Krull |
| 2004/0005969 | A1 | 1/2004 | Chen |
| 2004/0023765 | A1 | 2/2004 | Krull |
| 2004/0220025 | A1 | 11/2004 | Krull |
| 2005/0079961 | A1 | 4/2005 | Dalebout et al. |
| 2005/0085351 | A1 | 4/2005 | Kissel |
| 2006/0025287 | A1 | 2/2006 | Chermack |
| 2006/0063650 | A1 | 3/2006 | Francis |
| 2006/0100069 | A1 | 5/2006 | Dibble et al. |
| 2006/0105889 | A1 | 5/2006 | Webb |
| 2006/0116249 | A1 | 6/2006 | Dibble et al. |
| 2006/0135328 | A1 | 6/2006 | Doudiet |
| 2006/0205571 | A1 | 9/2006 | Krull |
| 2006/0211550 | A1 | 9/2006 | Crawford et al. |
| 2006/0217245 | A1 | 9/2006 | Golesh et al. |
| 2006/0223684 | A1 | 10/2006 | Krull |
| 2007/0203001 | A1 | 8/2007 | Krull |
| 2007/0275836 | A1 | 11/2007 | Parviainen |
| 2008/0026921 | A1 | 1/2008 | Liu |
| 2008/0039299 | A1 | 2/2008 | Crawford et al. |
| 2008/0085821 | A1 | 4/2008 | Webb |
| 2008/0176722 | A1 | 7/2008 | Steffee |
| 2008/0254952 | A1 | 10/2008 | Webb |
| 2009/0186748 | A1 | 7/2009 | Golesh et al. |
| 2010/0035736 | A1 | 2/2010 | Crawford et al. |
| 2011/0003668 | A1 | 1/2011 | Crawford et al. |

FOREIGN PATENT DOCUMENTS

| | | | |
|---|---|---|---|
| EP | 0617986 | A1 | 10/1994 |
| EP | 1614450 | A1 | 1/2006 |
| FR | 1468902 | | 2/1967 |
| FR | 2613237 | | 10/1988 |
| GB | 2232089 | A | 12/1990 |
| JP | 10118222 | | 5/1998 |
| SE | 455573 | | 7/1988 |
| SU | 1258447 | A | 9/1986 |
| SU | 1367987 | A | 1/1988 |
| SU | 1389789 | A | 4/1988 |
| SU | 1643024 | A | 4/1991 |
| SU | 1780780 | A1 | 12/1992 |
| TW | 379572 | | 1/2000 |

OTHER PUBLICATIONS

Nautilus Super Smooth Technology, "Equipment Comparison," undated brochure, 1 page.

PCT International Search Report of corresponding PCT International Application No. PCT/US2011/030831 dated Jun. 1, 2011, 2 pages.

U.S. Appl. No. 13/077,012, filed Mar. 31, 2011, Webb.

U.S. Appl. No. 13/077,013, filed Mar. 31, 2011, Webb et al.

ENGAGEMENT INTERFACE FOR AN EXERCISE MACHINE

CROSS-REFERENCE TO RELATED APPLICATIONS

This application claims the benefit, under 35 U.S.C. §119(e), of U.S. Provisional Application No. 61/319,567, entitled "Engagement Interface for an Exercise Machine" and filed on Mar. 31, 2010, which is hereby incorporated by reference herein in its entirety.

FIELD OF THE INVENTION

The present disclosure relates to exercise machines. More particularly, the present disclosure relates to exercise machines including selectable resistance loadings. Still more particularly, the present disclosure relates to exercise machines with selectable resistance loadings in the form of associating one or more weight plates with a user engagement interface.

BACKGROUND

Exercise may take several forms including aerobic or cardiovascular training, strength training, flexibility training, and balance training. With particular regard to strength training, two common forms include free weights and exercise machines. In the case of weight training exercise machines, it is common for the machines to include a user interfacing portion such as a graspable bar or handle, a foot press, a leg pad, or other interface. The interface may be connected to a cable or series of cables that may pass through one or a series of pulleys and may be connected to one or more weight plates.

A common exercise machine may include a weight stack where each plate in the stack is adapted to slide along two guide rods. The cable in these machines may be attached to a selecting rod passing through the weight stack and having multiple holes adapted to align with holes in each of the plates in the stack. A selection pin may be inserted into one of these multiple holes via a hole in a respective weight plate thereby engaging the selected plate, and all of the plates above it, with the selecting rod. As such, when the user manipulates the user interfacing portion, the cable pulls on the selecting rod causing the selected weights of the weight stack to be lifted along the two guide rods. Accordingly, a user may repetitively lift the selected weights to develop the muscular fatigue common in weight training.

SUMMARY

In one embodiment, an engagement interface for an exercise machine for selectively engaging a carriage with one or more resisting elements may be provided. The engagement interface may include one or more engagement devices arranged on the carriage and an engagement feature positioned on a resisting element. Each engagement device may include a first portion and a second portion extending from the first portion. The engagement feature may be configured for engagement by at least one of the one or more engagement devices. The engagement feature may include a body attached to the resisting element, at least one wall extending generally perpendicular to the body, a first tab extending from the at least one wall in a first direction and a second tab extending from the at least one wall in a second direction opposite the first direction. The first and second tabs may be configured to engage at least one of the one or more engagement devices.

In another execution, an exercise machine having two or more selectable loadings may be provided. Each loading may include one or more resisting elements engaged with a carriage. The machine may include a resistance system including the one or more resisting elements. The resisting elements may include vertically oriented weight plates arranged in a deck. The machine may also include a carriage, the engagement interface described above for selectively engaging the carriage with the resistance system, a single guide pole for guiding travel of the carriage, and a guide member configured to inhibit swinging of the carriage about the guide pole.

In one execution, the exercise machine may include a frame and two or more selectable loadings, each loading including one or more resisting elements engaged with a carriage. The machine may include a resistance system that includes the one or more resisting elements, a carriage, and one or more engagement devices arranged on the carriage. The one or more resisting elements may take the form of vertically oriented weight plates arranged in a deck. Each engagement device may include a first portion, and a second portion extending from the second portion. An engagement feature may be positioned on a resisting element and configured to engage at least one of the engagement devices. The engagement feature may include a body joined to the resisting element, at least one wall extending generally perpendicular to the body, a first tab extending from the at least one wall in a first direction, and a second tab extending from the at least one wall in a second direction opposite the first direction. The first and second tabs may be configured to engage at least a portion of at least one of the engagement devices. The carriage may be guided by a single guide pole operatively associated with the frame and the carriage. The guide pole and the carriage may be configured to guide travel of the carriage along the guide pole. A guide member may be operatively associated with the frame and the carriage. The guide member and the carriage may be configured to resist swinging of the carriage about the guide pole.

While many executions of the exercise machine are disclosed herein, still others will become apparent to those skilled in the art from the following detailed description, which shows and describes illustrative embodiments of the exercise machine. As will be realized, by those of ordinary skill in the art upon reading the following disclosure, the exercise machines disclosed herein may be modified in various aspects, all without departing from the spirit and scope of the exercise machines described herein. Accordingly, the drawings and detailed description are to be regarded as illustrative in nature and not restrictive.

DESCRIPTION

The present disclosure relates to an engagement interface between a carriage and a resistance system in a loading portion of an exercise machine. The carriage may include one or more engagement devices. Each engagement device may be configured to selectively engage at least one weight plate via an engagement feature on the weight plate to selectively join a desired number of weight plates to the carriage. The engagement devices may be positioned in or along a shaft, and the carriage may be guided in the machine by a single guide pole. The carriage may include a guide pole engaging portion adapted to engage the guide pole and resist torsion effects on the carriage from unbalanced loadings on the carriage. The weight plates may be vertically oriented and arranged in a horizontal spaced apart deck and may be positioned to be selectively joined to the carriage by one or more engagement devices. The weight plates may be generally T-shaped and supported near their outer edges by a rail extending along each side of the vertically oriented weight plates.

Figure 1:
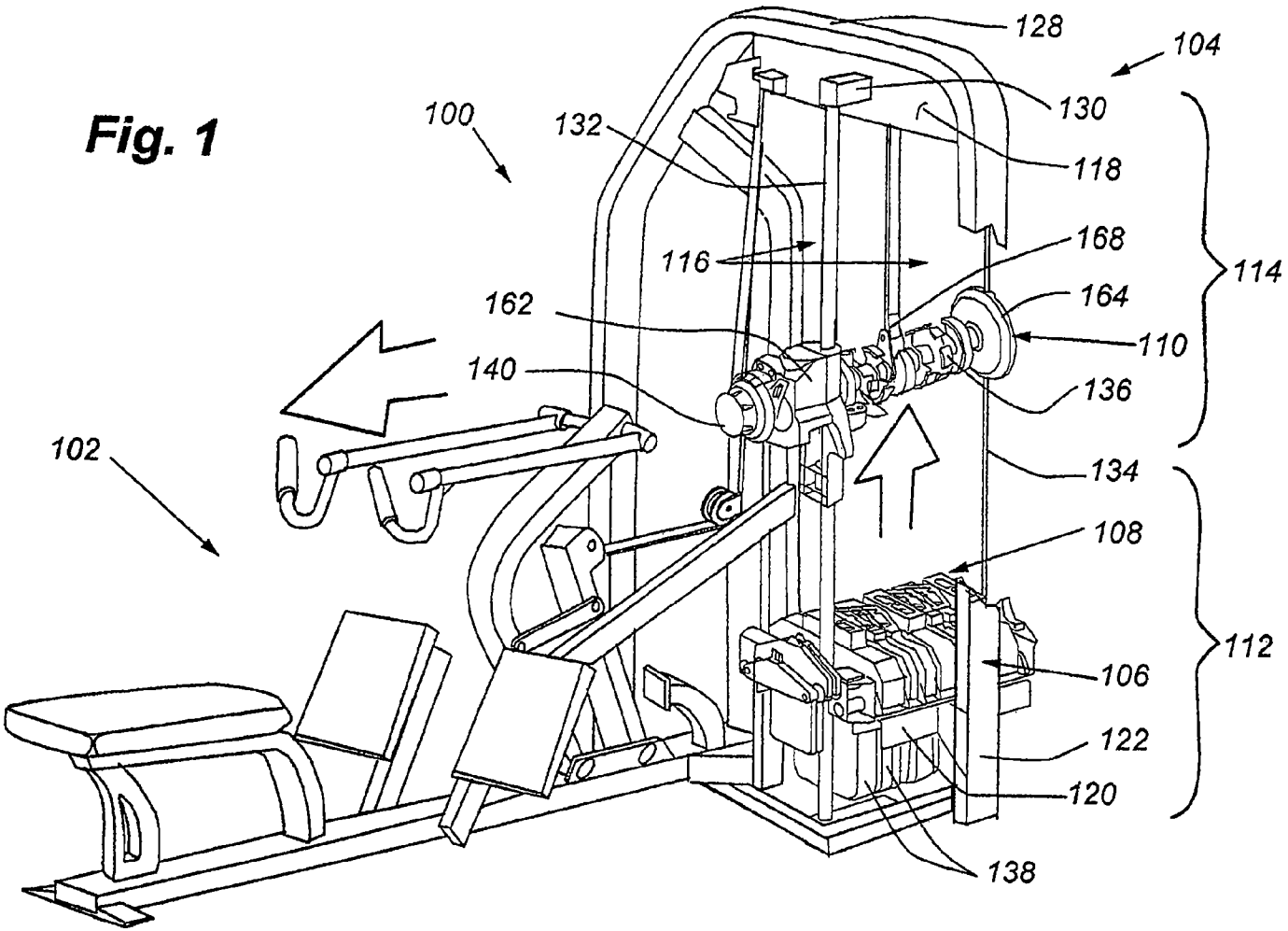
FIG. 1 is an isometric view of an exercise machine according to one embodiment.

Referring now to FIG. 1, an exercise machine 100 is shown with a user interface 102 and a loading portion 104. The loading portion 104 may be adapted for use with a variety of user interfaces 102. For example, the loading portion 104 may be incorporated into an upright row machine similar to that shown, a lat pull down machine, a leg extension or leg curl machine, or another similar weight training exercise machine. The loading portion 104 may include a frame 106, a resistance system 108 including one or more resisting elements, and a carriage 110. The loading portion 104 may be associated with the user interface 102, and the carriage 110 may be used to select a desired number of the resisting elements. As a user exercises, the carriage 110 may be guided along the frame 106 in conjunction with all or a portion of the selected resisting elements, such as, for example weight plates. Forces induced by the user on the user interface 102 may be transmitted via the frame 106 and the carriage 110 to the selected resisting elements, and the motion of the user interface 102 against the selected resistance may allow the user to perform a selected amount of work.

With particular regard to the frame 106, the frame 106 may include a base 112, an offsetting portion 114, and a guide structure 116. The base 112 may be configured to provide a stable structure for supporting and/or housing the resistance system 108 and the carriage 110. The offsetting portion 114 may extend from the base 112 and may include a junction mechanism 118 at an end opposite the base 112. The frame 106 may be configured to resist compressive forces induced as the junction mechanism 118 is relied upon to support the resistance system 108 as the resistance system 108 is lifted away from the base 112. For example, in one embodiment of a frame 106, the junction mechanism 118 may be in the form of a pulley such that a tension member, which may be a cable or the like, joined to the user interface 102 may pass therethrough and extend to the carriage 110 to operatively join the carriage 110 to the user interface 102. Force on the associated user interface 102 may induce tension in the cable that may be resisted by the resistance system 108 and, in turn, the compressive strength of the frame 106. Accordingly, the base 112 and the offsetting portion 114 may include tubular structures, wall type structures, or other structures configured to maintain their shape under compressive loading. The guide structure 116 may include tracks, guide rods, guide cables, guide wires, tubes, or other structures configured to guide the motion of the carriage 110 and/or the resisting elements of the resistance system 108 in the frame 106.

Figure 2:
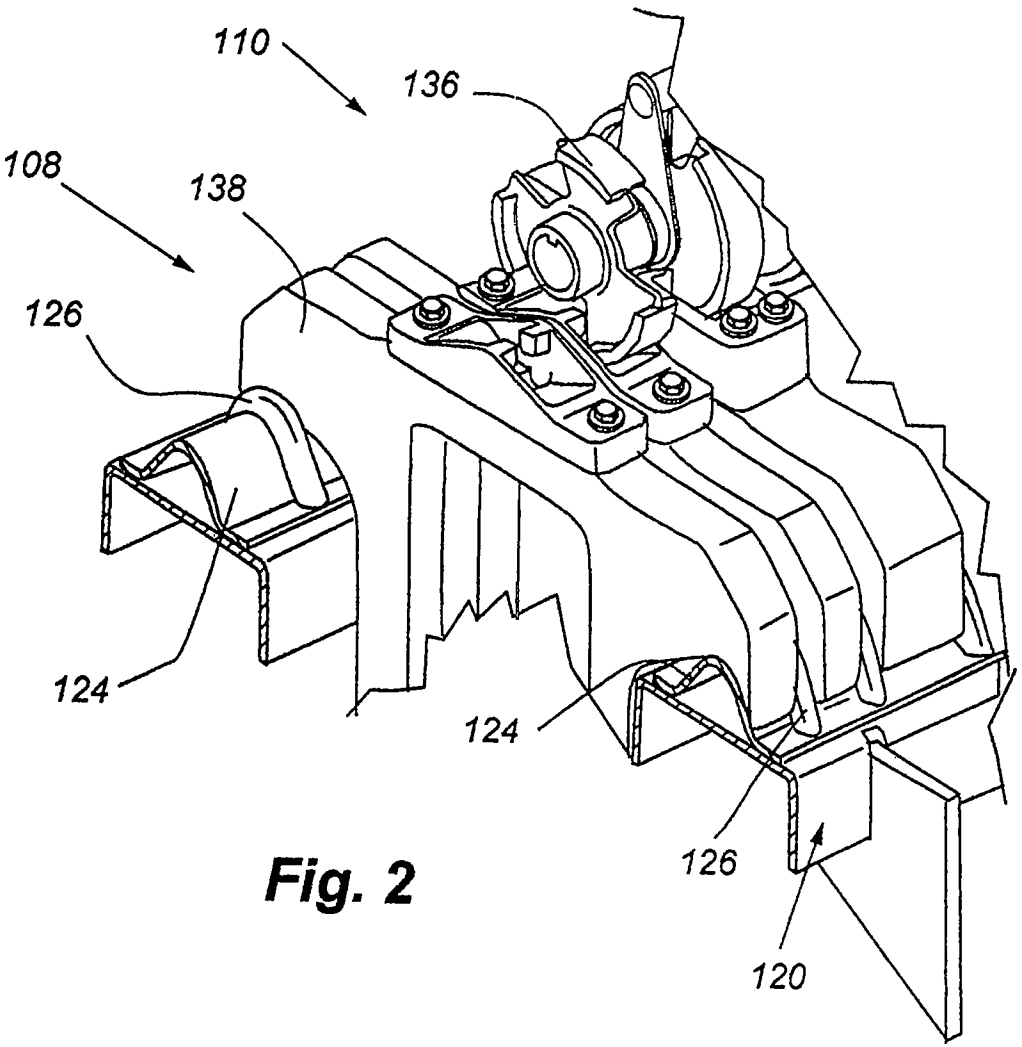
FIG. 2 is a close-up isometric view of a portion of a frame and carriage of the machine of FIG. 1.
Figure 5A:
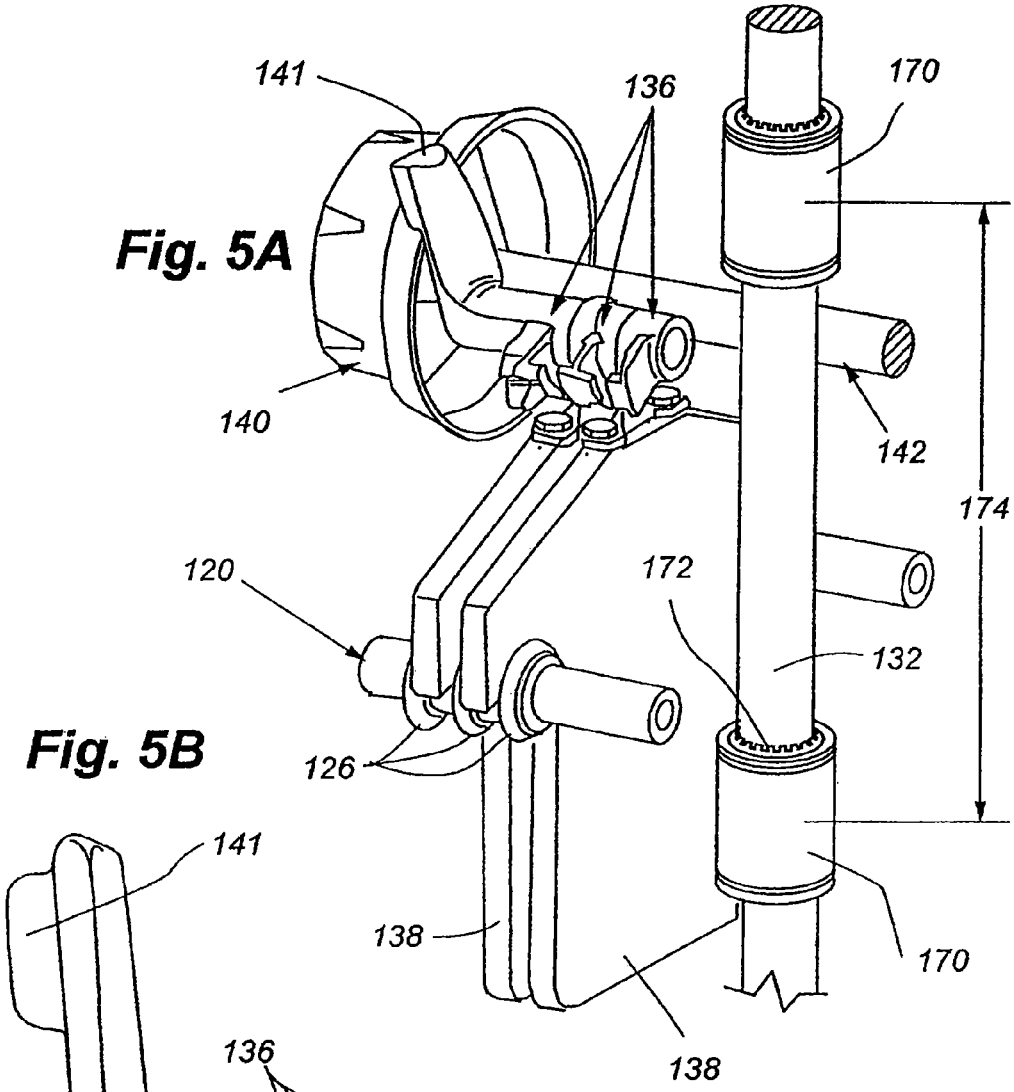
FIG. 5A is a partial isometric view of the carriage and the resistance system of FIG. 3.

In the particular embodiment shown in FIG. 1, the base 112 may include a pair of rails 120, each positioned perpendicular to a vertically extending tube 122. The rails 120 may be configured for supporting the resisting elements of the resistance system 108. Each rail 120 may include a channel or angle member in the form of an extruded C-shape or L-shape respectively connected to the vertically extending tube 122 or supported via a box frame structure resting on another portion of the base 112. With reference to FIG. 2, each rail 120 may provide a supporting surface where a resisting element holding feature 124 may be provided. With continued reference to FIG. 2, the holding feature 124 may include a longitudinally extending peak that is shaped to receive a similarly shaped recess in a resisting element, such as a weight plate or the like. The resisting element holding feature 124 may also include spacer guides 126 positioned along the length of the holding feature 124 to define slots for maintaining the weight plates in a spaced condition and in their proper alignment relative to the frame 106. In some embodiments, the longitudinally extending peak may be formed from a flat piece of metal that is bent into the desired shape, and the spacer guides 126 may take the form of rods positioned perpendicular to the longitudinally extending peak and formed to follow the contour of the longitudinally extending peak. The shape of the holding feature may match or nearly match the profile shape of a supported portion of a resisting element as best shown in FIG. 2. In other embodiments, the rail 120 or other portion of the rail 120 may be in the form of a tube, pipe, rod, or the like, and the spacer guides 126 may be in the form of washers or other annular or torospherically shaped elements affixed along the length of the rail 120, as shown in FIG. 5A, for example. In these embodiments, the holding feature 124 may be omitted as the rail 120 may provide the support surface for the resisting element. While a bent metal plate has been described for the holding feature 124, plastics, composites, other materials, or some combination thereof may also be utilized.

Returning to FIG. 1, the offsetting portion, or top portion, 114 of the frame may be formed by an extension of the vertically extending tubes 122, which may connected at an end distal the base 112 by a cross member 128. A transverse member 130 may also be provided at the end distal the base 122. A guide pole 132 and a guide member 134 may each extend between the base 112 and the offsetting portion 114 of the frame 106. The guide pole 132 maintains the course of travel of the carriage 110 as it travels along the frame 106, and the guide member 134 minimizes swinging of the carriage 110 about the guide pole 132. The guide member 134 may be a cable, a wire, a tension rod, a tube, or other suitable member. When the guide member 134 takes the form of a flexible member, such as a cable or wire, the guide member may be tensioned between the offsetting portion 114 and the base 112 to facilitate better resistance to swinging motions of the carriage 110. This taut flexible member may also facilitate better sliding of the sleeves of the counterweight along the flexible member. This is described in more detail below.

Figure 3:
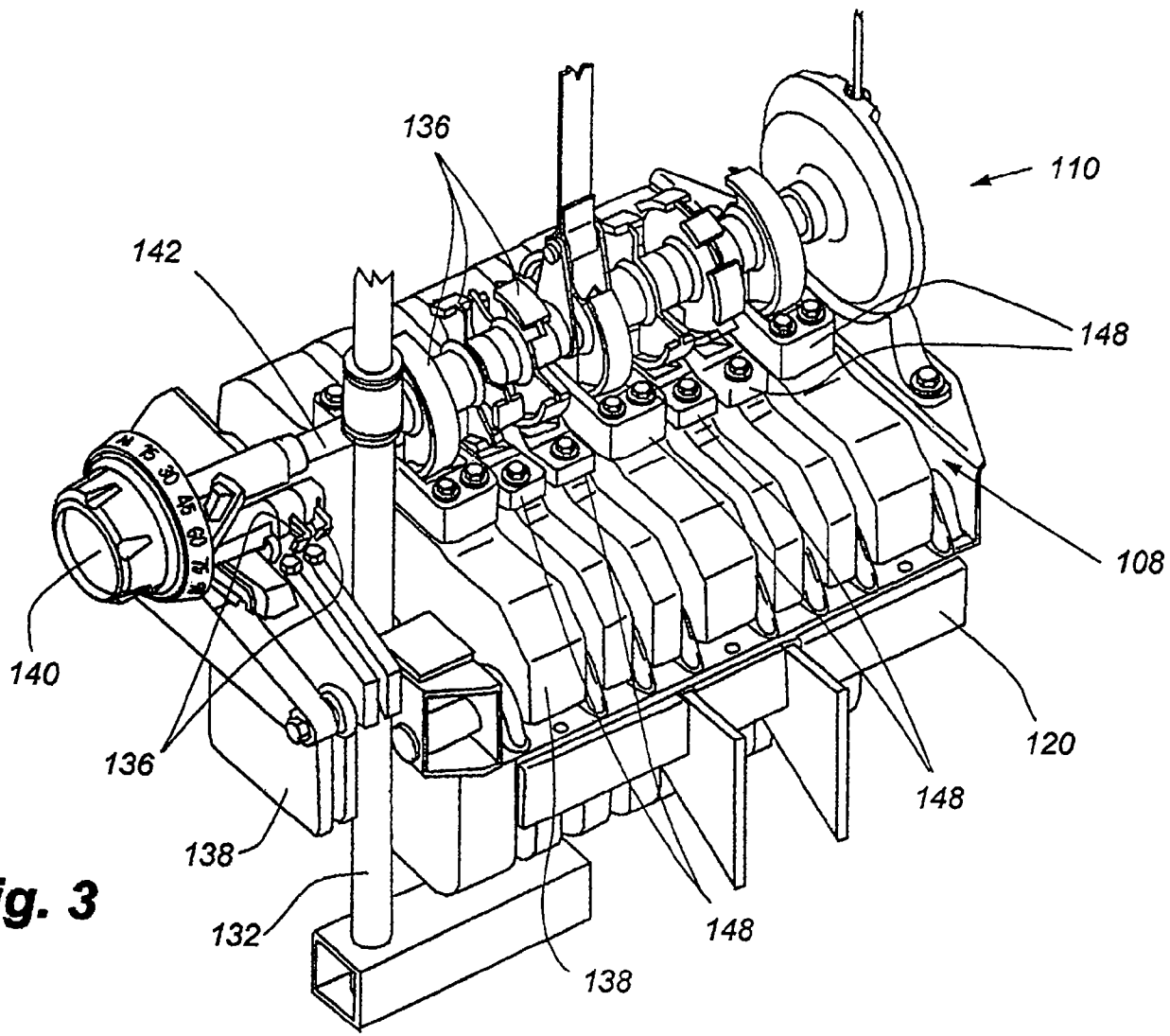
FIG. 3 is an isometric view of a carriage and resistance system of the machine of FIG. 1.

The carriage 110 may include one or more engagement devices 136 for engaging one or more of the resisting elements 138 of the resistance system 108. The carriage 110 may also include a selection mechanism 140 for selecting the amount of resistance desired. With reference to FIG. 3, the carriage 110 may further include a support system 142 for supporting the engagement devices 136 and adjusting them via the selection mechanism 140. Returning to FIG. 1, the carriage 110 may be positioned in the loading portion 104 of the exercise machine 100, and the engagement devices 136 may be arranged along the carriage 110 so as to associate the engagement devices 136 with one or more resisting elements 138 of the resistance system 108. The selection mechanism 140 together with the support system 142 may be configured for adjustment of the engagement devices 136 between engaged conditions or disengaged conditions with their respective resisting element or elements 138 to provide a selected loading.

In some embodiments of a selection mechanism 140 and associated support system 142, as shown in FIG. 3, a dial and shaft, respectively, may be used. In these embodiments, rotationally actuated engagement devices 136 may be mounted along the length of the shaft. The spacing of the engagement devices 136 may be such that the engagement devices 136 are in alignment with a respective resisting element 138, such as a weight plate in a weight stack. The shaft may be associated with the dial such that rotation of the dial causes an associated rotation of the shaft. Here, the selection mechanism 140 in the form of a dial may be rotated to select a desired loading. The support system 142 in the form of a shaft may transmit the rotational motion of the dial to the engagement device or devices 136 causing the rotational actuation of the engagement device or devices 136. In the embodiment shown, the dial may include several weight increments (e.g., 15 lb increments) around its perimeter allowing the user to select a particular amount of weight to use during exercise. For any given degree of rotation on the dial, the corresponding radial position of the plurality of engagement devices 136 causes a particular set of engagement devices 136 to be engaged with respective resisting elements 138 of the resistance system creating the indicated load reflected on the dial. A gear reducer may be used, if desired, so there is not a 1:1 correspondence between rotation of the dial and rotation of the engagement devices 136.

Figure 5B:
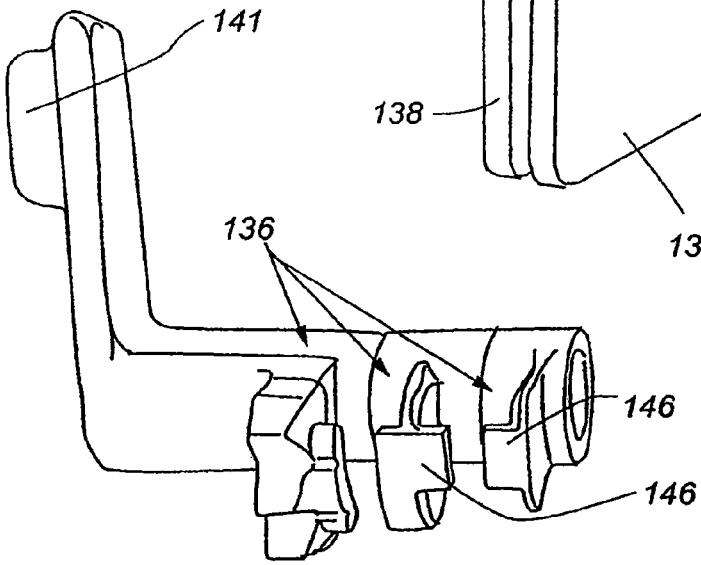
FIG. 5B is an enlarged isometric view of a portion of the selection mechanism.

With reference to FIGS. 5A and 5B, additional engagement devices 136 may be provided to engage one or more resisting elements 138 by actuation of a lever 141, thereby isolating the respective engagement devices 136 from the rotation of the dial 140 and the shaft. In this means of selecting additional weights, the lever 141 is moved to rotate the engagement devices 136 of FIG. 5A about an axis, which may be offset from the axis of rotation of the shaft of the support system 142. The movement of the engagement devices 136 in this manner positions flange portions 146 (FIG. 5B) of the engagement devices 136 relative to the engagement features 248 on the resisting elements 138 as described in more detail below with respect to FIGS. 9A and 9B. As such, smaller increments of weight may be included allowing for selection of weight values that fall between the incremental values available on the main dial. This additional mechanism for selecting weights is not limited to selecting only smaller increments of weights. Additionally, other selection mechanisms for joining add-on weight to the carriage 110 may be used in place of the add-on selection mechanism shown in FIGS. 5A and 5B.

In one alternative embodiment, the lever 141 may be omitted and the smaller increments of weight can be added through turning the dial. In this embodiment, a similar large increment (e.g., 15 lbs) can be provided on the dial. In addition, smaller (e.g., 5 lb) increments may be included. The dial may include tripping tabs that trip a serrated gear every third gradation of dial turn for example. In this embodiment, as the dial is turned to 5 lbs, a first 5 lb add-on plate is picked by a engagement device on a add-on shaft. As the dial is turned to 10 lbs, and additional 5 lb add-on weight is selected. As the dial is turned to 15 lbs, the add-on weights are unselected and the tripping tab encounters a tooth on a gear on a main shaft causing the main shaft to engage a 15 lb weight. This process continues to the full weight of the weight stack. In this particular embodiment, the total weight of weights in the weight stack may be 240 pounds ("lbs").

The type of selection mechanism 140 and the type of support system 142 may depend, in part, on the type of engagement device 136 that is provided. In some embodiments, a longitudinally actuated engagement device 136 may be provided. The longitudinally actuated engagement device may include a slide type selection mechanism 140 and support system 142, where the selection mechanism 140 includes a handle or series of handles that slide along a graded scale, and the support system 142 in the form of a bar or rod extends from the handle to the engagement device 136. Longitudinal motion of the support system 142 may cause a engagement device 136 to longitudinally engage a resisting element 138. In another embodiment of a longitudinally actuated engagement device 136, a dial type selection mechanism 140 may be combined with a screw type support system 142. In this embodiment, a rotating dial may allow for selection of a particular resistance, and the rotation of the dial may turn a support system 142 in the form of a screw which may cause longitudinal motion of a engagement device 136 to longitudinally engage a resisting element 138. Rack and pinion type interfaces between the support system 142 and the engagement devices 136 may also be used to change the direction of travel of the engagement device 136 relative to the support system 142. Additionally, pivot pins may be provided to cause engagement devices 136 to swing in and out of engaged positions with resisting elements 138.

Figure 4:
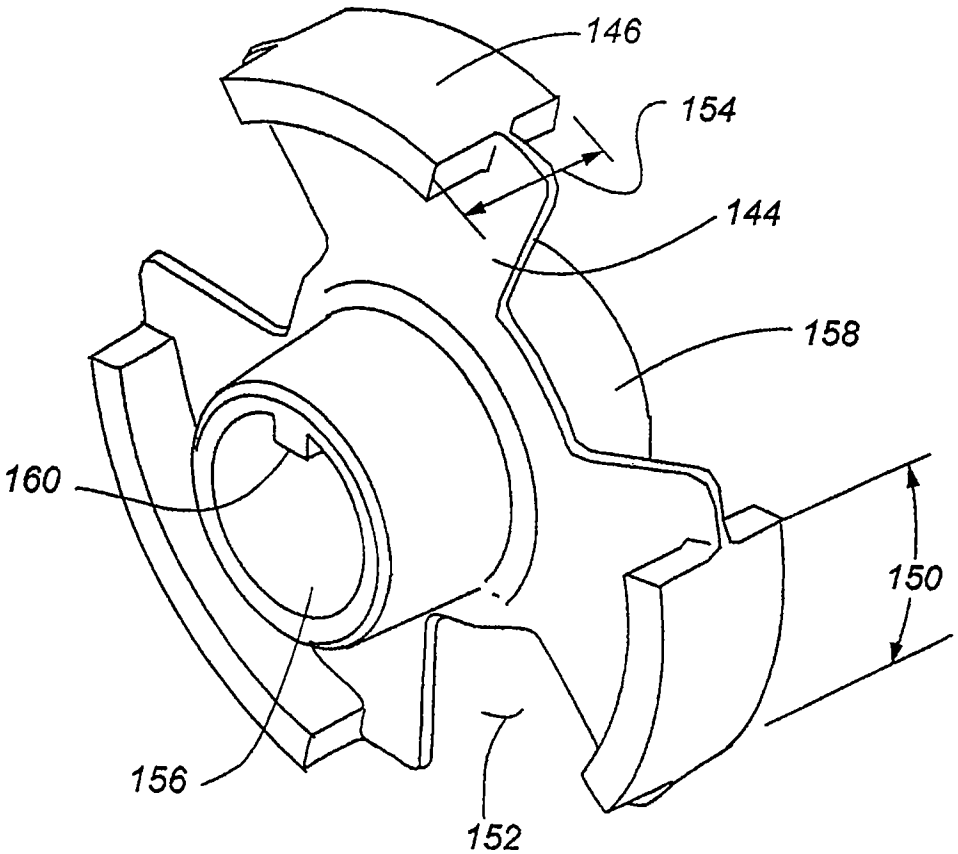
FIG. 4 is an isometric view of a engagement device from the carriage of FIG. 3.

Turning now to FIGS. 3 and 4, one or more engagement devices 136 may be configured for selective engagement with one or more resisting elements 138 of the resistance system 108. With reference to FIGS. 3 and 4, each engagement device 136 may include a reaching portion 144, which may also be referred to as a first portion, and a flange portion 146, which may also be referred to as a second portion. The reaching or first portion 144 may extend into or past an engagement feature 148 on a resisting element 138, and the flange or second portion 146 may extend from the reaching portion 144 to engage the engagement feature 148 of the resisting element 138.

Referring particularly to FIG. 4, an isometric view of an engagement device 136 is shown. The engagement device 136 may include a disc-shaped first portion 144 and annular second portion 146. The engagement device 136 may have a first portion 144 in the form of a generally straight portion, and a second portion 146 in the form of a generally curved portion extending in opposing directions from the first portion 144 and oriented generally orthogonally to the first portion 144 to form a T-shaped structure or the like. The engagement device 136 may take the form of a radial extrusion of the T-shape. As such, the first portion 144 may form the shape of a disc having a circular outer edge, and the second portion 146 may form the shape of an annular ring positioned along the circular outer edge of the disc. The second portion 146 of the engagement device 136 may be discontinuous or interrupted one or more times to allow for engagement in some radial positions, but not others. In some embodiments, the flange length 150 along the perimeter of the engagement device 136 may include the full perimeter, or at least most of the perimeter, and in some embodiments the flange length 150 along the perimeter may be quite less and may be as short as ½ inch. The disc shaped first portion 144 may include void spaces or interruptions 152 where the second portion 146 is interrupted or discontinuous. Alternatively, the disc portion can be continuous through the areas where the second portion is interrupted. In addition, the remaining portion of the disc shaped first portion 144 may be generally solid, but openings may also be provided making the circular disc shaped first portion 144 have discrete radially-extending sections, similar to a mag or spoke-type wheel, which when considered relative to the entire first portion may be considered circular.

Additionally, depending on the particular position and purpose of the engagement device 136, all or a portion of the width 154 of a second portion 146 may be omitted. For example, as shown for the middle engagement device 136 in FIG. 5B, the width 154 of the second portion 146 may be provided extending in opposing directions for a portion of the perimeter, but may extend only in one direction over other portions of the perimeter. This particular arrangement may be provided where the engagement device 136 works in conjunction with an adjacent engagement device 136 to engage a resisting element 138. Many combinations of the directions and lengths for the widths 154 of the second portions 146 along the perimeter of the disc may be provided and may be selected based on the design of the loading portion 104 of the exercise machine 100 and the particular position of the engagement device 136 within the carriage 110.

The engagement devices 136 may include a wide range of sizes depending, in part, on the size of the loading portion 104 of the machine 100 and the forces induced on the engagement devices 136 by the resisting elements 138. In some embodiments, the disc type engagement devices 136 shown may have a diameter, measured to the outer face of the second portion 146, ranging from approximately 1 inch to approximately 12 inches. In another embodiment, the diameter may range from approximately 2 inches to approximately 6 inches. In another embodiment, the diameter may be approximately 3½ inches. In one embodiment, the width 154 of the flange or second portion 146, for example an engagement device 136 with a reaching or first portion 144 and a flange or second portion 146 defining a T-shape, may range from approximately ¼ inch to approximately 2 inches. In another embodiment, the width 154 may range from approximately ½ inch to approximately 1 inch. In still another embodiment, the flange or second portion 146 may have a width 154 of approximately ¾ inch.

The engagement devices 136 may be adapted for positioning along a support system 142 including a shaft. Accordingly, with reference to FIG. 4, the disc shaped reaching or first portion 144 of the engagement device 136 may include a center hole 156 adapted to receive the shaft causing the disc to have a generally planar annular shape with a circular inner edge and a circular outer edge. A collar 158 may be provided along the circular inner edge to strengthen the opening for receiving the shaft. A key 160 may also be provided for engaging a keyway that extends along the length of the shaft. The key 160 may be a rectangular protrusion extending from the wall of the center hole 156. Any shaped key 160 may be provided so long as it secures the engagement device 136 against rotation relative to the shaft. In some embodiments, a set screw or other securing mechanism may be provided extending into the center hole 156 for securing the engagement device 136 along the length of the shaft.

Many arrangements may be provided for the engagement device 136 including L-shapes, J-shapes, T-shapes, arrow shapes (e.g., ↑) or other shapes allowing for engagement with an engagement feature 148. For example, a C-shape may be used where the reaching or first portion 144 is formed from a first portion of a C-shape and the second portion 146 is a continuation of the reaching or first portion 144 by way of the remaining portion of the C-shape. Other shapes may also be provided. Depending on the type of engagement feature 148 being engaged, the engagement device 136 may be an extruded form of the shapes described or may be limited to the shape described. For example, with regard to an L-shape, an extruded form of a L-shape may be provided similar to a steel angle. In contrast, where an extruded form is not provided, for example with regard to a J-shape, the engagement device 136 may be in the form of a hook. With regard to extruded shapes, the extrusion may be a linear extrusion, radial extrusion, rectangular extrusion, or other type of extrusion. The term extrusion here is used to describe the shape of the engagement device relative to a starting or cross-sectional shape and does not require that the element or elements be made with an extrusion process.

Figure 6:
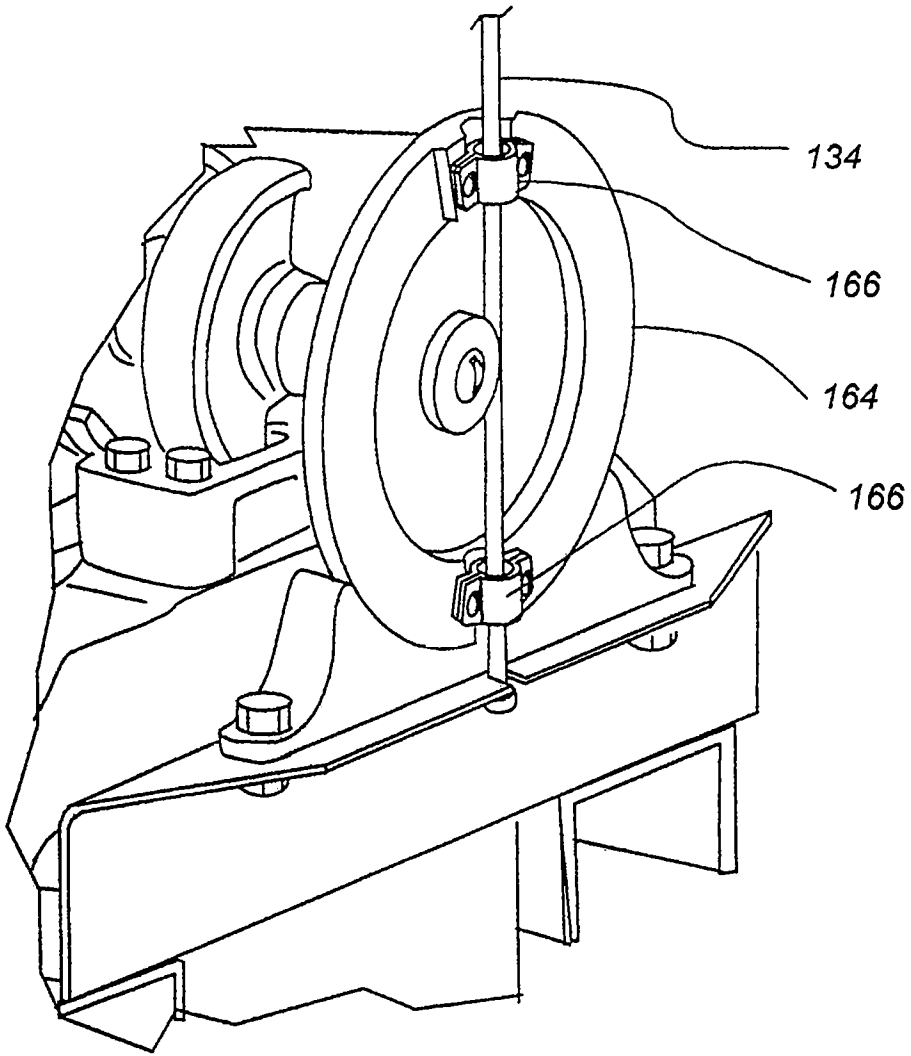
FIG. 6 is another partial isometric view of the carriage and resistance system of FIG. 3.

Referring again to FIG. 1, in addition to the selection mechanism 140, the support system 142, and the engagement devices 136, the carriage 110 may also include a guide pole engaging portion 162, a counterweight 164, and a guide member engaging portion 166 (see FIG. 6). The guide pole engaging portion 162 may be configured to movably anchor the carriage 110 to the guide pole 132 such that motion of the carriage 110 along the frame 106 proceeds with little to no deviation from the direction in which the guide pole 132 extends. As such, the guide pole engaging portion 162 may include bearings, low friction materials, or other devices to allow the carriage 110 to slide along the guide pole 132. Regarding the counterweight 164, this element may be configured to balance the weight of several of the elements of the carriage 110 about the connection point 168 of the carriage 110 to a lifting lug. As such, when no resisting elements 138 are engaged, the counterweight 164 may balance the weight of, for example, the dial and the guide pole engaging portion 162 about the connection point 168 to a lifting cable. With particular reference to FIG. 6, the counterweight 164 may be a mass of material positioned on the carriage 110 so as to somewhat balance the forces acting on the carriage 110. Regarding the guide member engaging portion 166, this element may include loops, sleeves, or other friction reducing elements that sleevably receive the guide member 134. Accordingly, as the carriage 110 travels along the frame 106, the guide member 134 is engaged by the guide member engaging portion 166, thus reducing the tendency of the carriage 110 to swing about the guide pole engaging portion 162.

Referring to FIG. 3, and particularly to FIG. 5A, the guide pole engaging portion 162 may include one or more bosses 170 configured to slidably engage the guide pole 132. The housing of the pole engaging portion 162 is not shown in FIG. 5A for clarity. The bosses 170 may include low friction sleeves such as annular rings. In addition, the annular rings may have longitudinally extending slots 172 on the inside face of the ring to reduce the contact area of the boss 170 with the guide pole 132, and thus reduce the friction. The bosses 170 may include Teflon or other low friction material. Alternatively, the bosses 170 may include roller bearings or ball bearings. Other types of bosses 170 may be used. In the embodiment shown, two bosses 170 are used and they are spaced apart by a tipping moment resisting distance 174. The distance 174 may range from approximately 4 inches to approximately 24 inches. In other embodiments, the distance 174 between the bosses 170 may be approximately 8 inches to approximately 16 inches. In still other embodiments, the distance 174 between the bosses 170 may be approximately 12 inches. In an alternative embodiment, a single boss 170 may used and may have length the same or similar to the moment resisting distances 174 described above. The guide pole 132 may be made of steel or other suitable material, and may have a circular cross section, or another cross sectional shape that corresponds to the shape of a hole defined by the boss 170, to facilitate the movement of the carriage along at least a portion of its length.

Turning now to the resistance system 108, and referring particularly, to FIG. 3, the resistance system 108 shown may include resisting elements 138 in the form of a multiple weight plates. The plates are shown with a vertical orientation in a horizontal spaced apart deck relationship and are supported by rails 120 of the frame 106, each rail 120 extending along one side of the stack of weight plates. The weight plates shown may include plates with similar front and rear profiles such that the weight plates may be arranged or stacked as shown on the rails 120. In alternative embodiments, the weights may be supported from the bottom and may be positioned in vertical slots and their profiles may vary from one plate to another. The weight plates shown, while all supported by a rail 120 on each side, are not limited to matching profiles and may be provided with any profile that allows for support by the rails 120. For example, the weight plates shown in FIG. 2 are relatively larger than those shown in FIG. 5.

Figure 7:
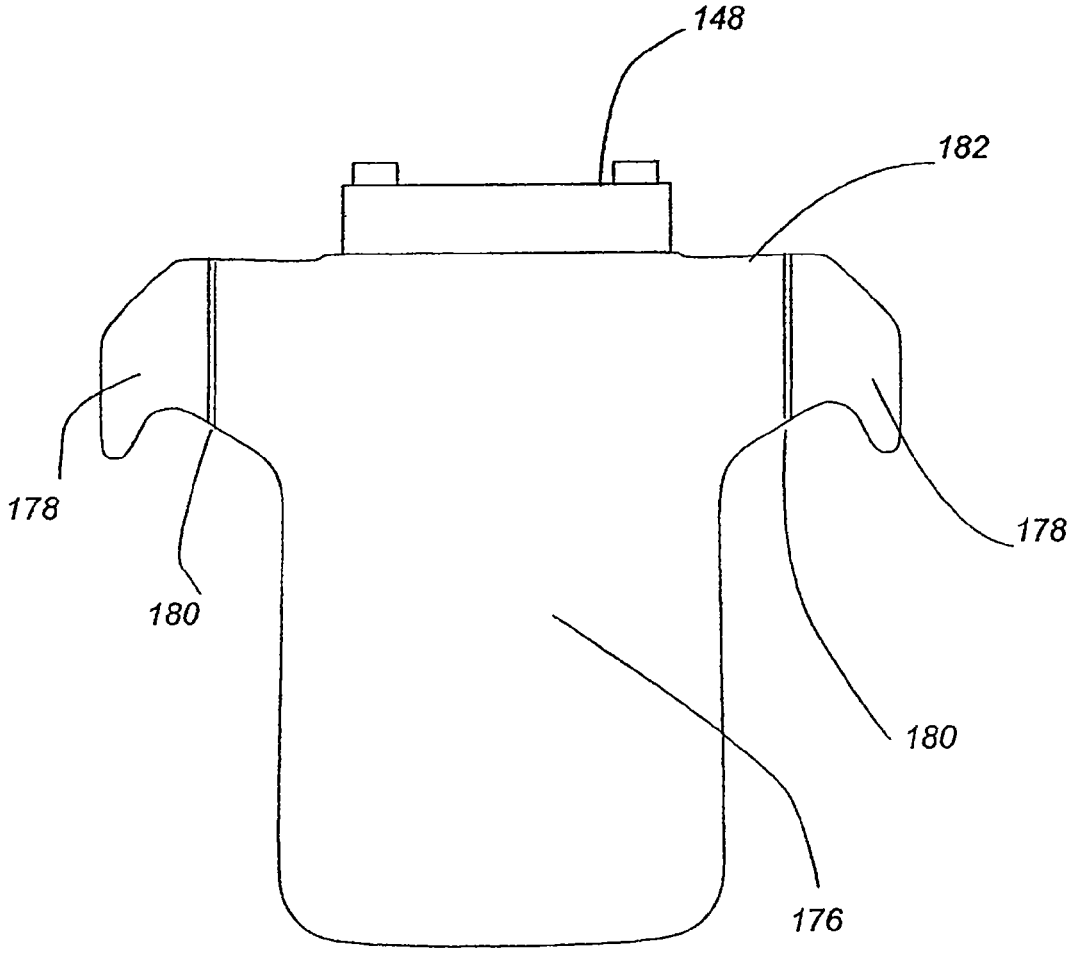
FIG. 7 is front profile view of a weight plate of the resistance system of FIG. 3.

The weight value of any given weight plate may be adjusted through adjustment of the plate thickness, the plate profile, the material used, and/or through omitting portions from the body of the weight. With reference to FIG. 7, the weight plates may have a generally T-shaped front and rear profile. The weights may have a main body portion 176 and two arm portions 178. The arm portions 178 may extend laterally from the main body portion 176. A supporting edge 180 may be provided at the intersection of the arm portions 178 to the body portion 176. The supporting edge may be shaped to match the shape of a respective holding feature 124 on a supporting rail 120, or to match the shape of the rail 120 when the holding feature 124 is omitted. A top edge 182 may extend along the top of the arm portions 178 and the body portion 176, and an engagement feature 148 may be joined thereto (see FIG. 8A). This top edge 182 may be relatively linear (i.e., FIG. 8A), or may be curved or faceted (FIG. 9A), or a combination thereof, as necessary to allow for the desired positioning between the engagement feature and the engagement device 136. In some embodiments, heavier plates may have a relatively broad shoulder and the lighter plates may have a more tapered shoulder. The intersections of the edges forming the T-shape may be radiused to provide for smoothed outer and inner corners. An opening or a recess 200 may be provided within the main body portion 176 of the weight plate to adjust the weight of the plate, while maintaining a consistent outer profile of the plate. The rails 120 of the base 112 may be spaced just greater than the width of the main body portion 176 of the weight plates.

While the resisting elements 138 shown are in the form of weight plates, the resisting elements 138 may take the form of springs, elastic elements, or any other suitable resisting element. In the case of weights, the weights may be in the form of plates, bars, or other masses with the same or different weight values where combinations of the weights may be used to provide several different loading conditions. In the case of springs or other elastic elements such as, for example, flexible rods, several elastic elements may be provided with the same or different elasticity where combinations of the elastic elements may be used to provide several different loading conditions. The resisting elements 138 may be adapted for engagement by one or more of the engagement devices 136 of the carriage 110. As such, the resisting elements 138 may have an engagement feature 148 positioned on the resisting element 138 such that it is accessible by an engagement device 136. The engagement feature 148 may be any shape allowing for the engagement devices 136 of the carriage 110 to selectively engage and disengage the resisting the elements 138. For example, the engagement feature 148 may be in the form of a hole for receiving a hook type engagement device 136. In another example, the engagement feature 148 may be in the form of a ledge for engagement by an L-shaped engagement device 136.

Figure 8A:
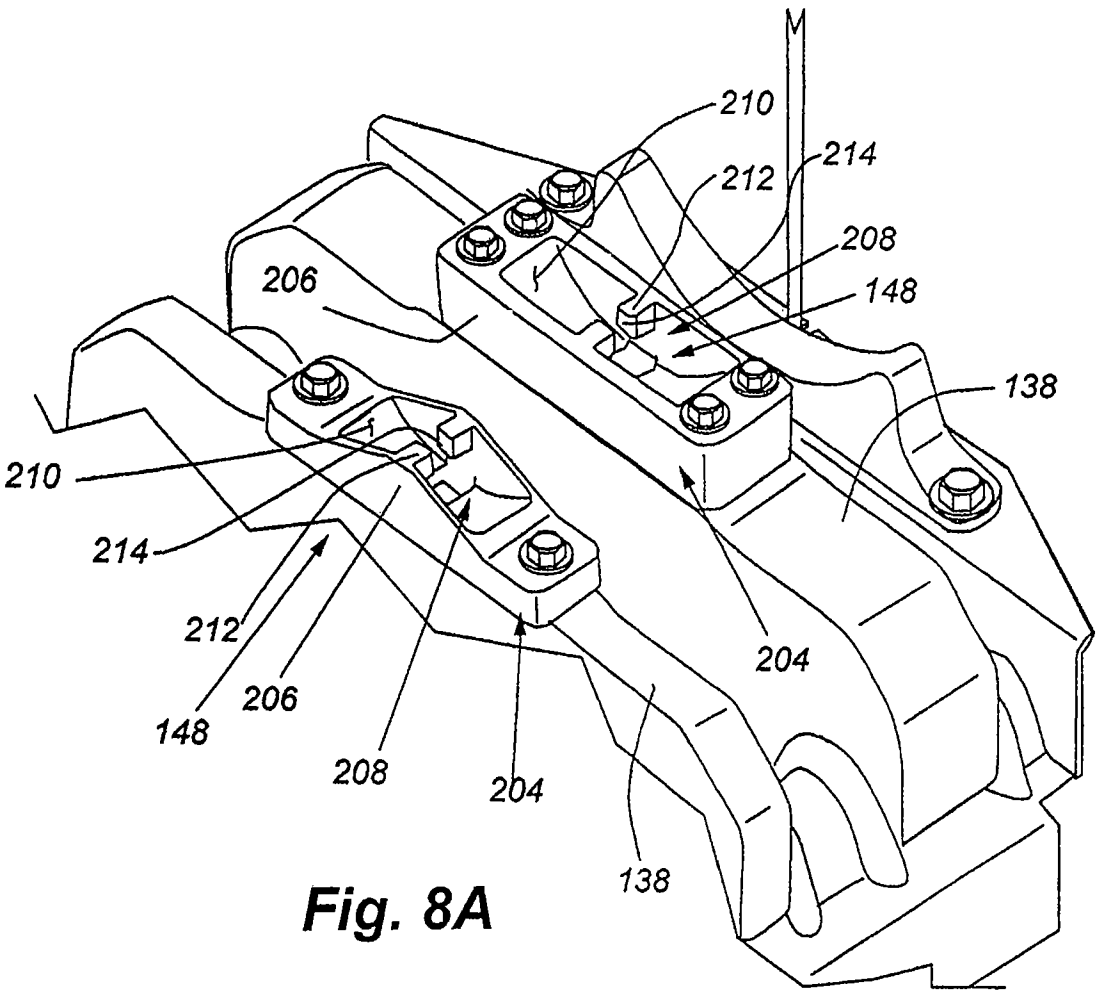
FIG. 8A is an isometric view of an engagement feature on a weight plate of the resistance system of FIG. 3.

The resisting elements 138, when taking the form of weight plates, may include an engagement feature 148 positioned along the top edge 182 of the plates. The engagement feature 148 may be adapted to be engaged by the engagement devices 136 described with respect to FIGS. 4 and 5. The engagement feature 148 may take at least two forms depending on the type of engagement device 136 being used to engage the respective resisting element 138. In a first embodiment, as shown in FIG. 8A, the engagement feature 148 may include a generally rectangular body 204 having a plurality of bores extending therethrough for securing the body 204 to the weight plate via bolts or other fasteners. The body 204 may also include a pair of sidewalls 206 extending away from the respective edge of the weight plate. The side walls 206 may be spaced from one another and may extend generally parallel to one another. The body 204 may also include a radiused trough 208 laterally defined by the sidewalls 206, where the trough 208 includes a bottom surface 210 defined by a radius. The radius may be slightly larger than the outer radius of the annular ring shaped flange portion 146 on a respective engagement device 136. The radius may also have a center point located at the center of a disk of a respective engagement device 136. The width of the trough 208 may be slightly larger than the width 154 of a respective flange or second portion 146, but small enough to prevent too much side to side movement of the weight plate relative to the engagement device 136.

Tabs 212 may be provided extending into the trough 208 from the sidewalls 206. The tabs 212 may be positioned generally centered along the length of the trough 208 and may be in general alignment with each another. The tabs 212 may extend into the trough 208 toward one another in opposing directions and may stop short of contacting one another to define a disc gap 214 between the tabs 212 slightly larger than the thickness of the generally planar disc of a respective engagement device 136. The sidewalls 206 may be generally rectangular and may provide for a relative deep trough 208, or the sidewalls 206 may be somewhat peaked toward their mid-length at the location of the tabs 212. In some embodiments, the peaked sidewalls 206 may be associated with lighter or less heavy weight plates, and the rectangular sidewalls 206 may be associated with heavier plates.

Figure 8B:
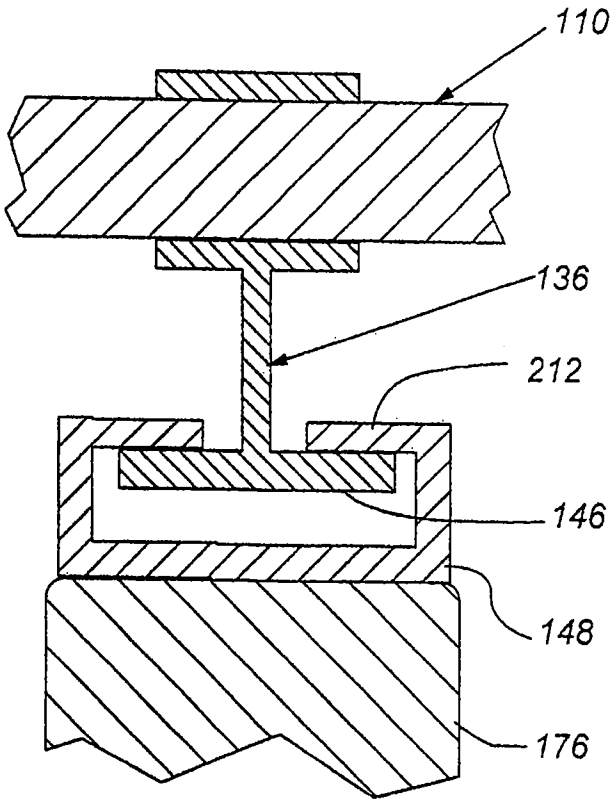
FIG. 8B is a schematic view similar to that of FIG. 2 in section, showing the flange or second portion of the engagement device engaged with the tabs of the engagement feature.

With reference to FIGS. 2, 8A and 8B, an engagement device 136 may be positioned relative to the engagement feature 148 such that the disc shaped reaching or first portion 144 of the engagement device 136 extends into the trough 208 between the tabs 212, and the flange or second portion 146 passes below the tabs 212 of the trough 208. With particular reference to FIG. 8B, when a portion of the flange or second portion 146 is positioned below the tabs 212 of the trough 208, the flange or second portion 146 of the engagement device 136 engages the tabs 212 of the engagement feature 148 when the carriage 110 is lifted by the lifting cable, and thus by this engagement lifts the weight off of the rail 120 of the support when the lifting cable is sufficiently tensioned. However, when the engagement device 136 is rotated such that a portion of the flange or second portion 146 is not below the tabs 212 of the trough 208, the flange or second portion 146 of the engagement device 136 does not engage the tabs 212, and thus may move freely away from the engagement feature 148 and the associated weight plate when the lifting cable is sufficiently tensioned. A selection location may be defined for the carriage travel where the center of the shaft for the support system 142, and thus the center of the disc shaped engagement devices 136, is positioned at the center defined by the radiused trough 208. As such, when the dial is rotated thereby rotating the engagement devices 136, the outer surface of the annularly shaped flange or second portion 146 of an engagement device 136 may pass along the surface 210 of the trough 208 in a respective engagement feature 148.

Figure 9B:
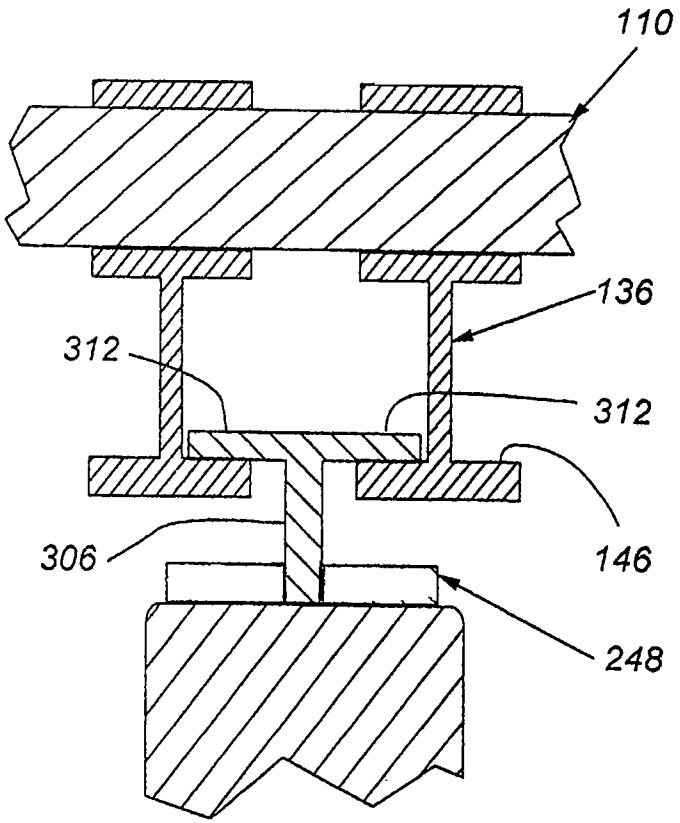
FIG. 9B is a schematic view similar to that of FIG. 5A in section, showing the engagement of the flange or second portion of the engagement device with the tabs of the engagement feature.
Figure 9A:
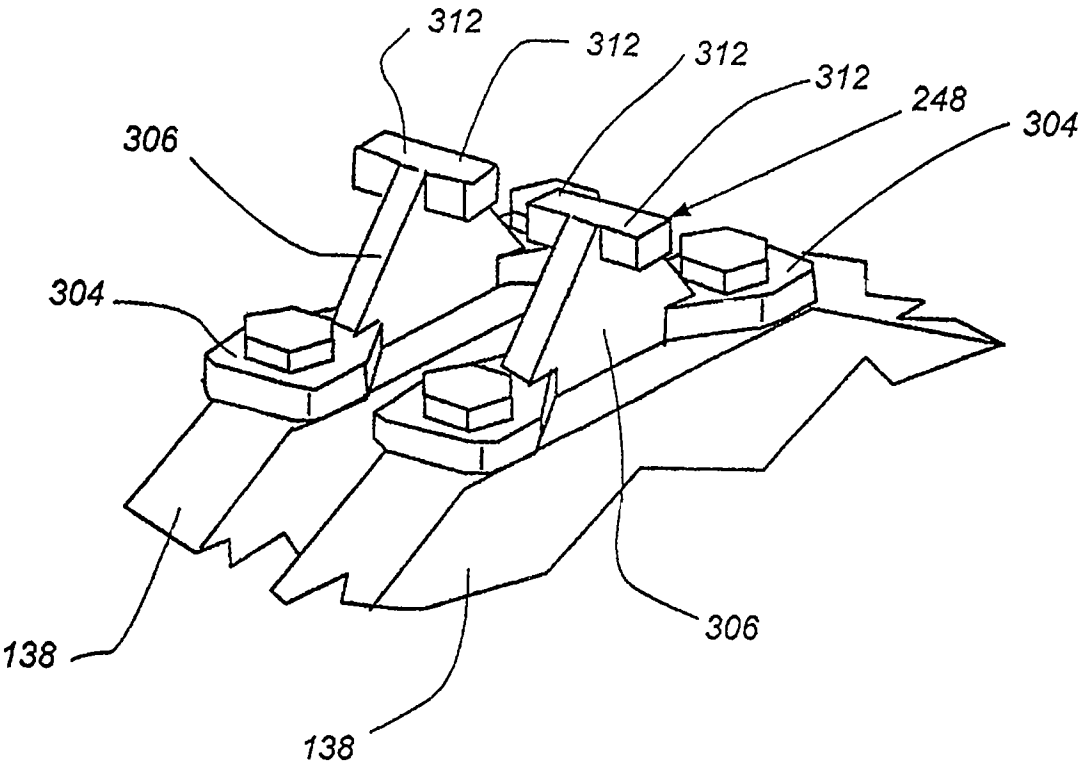
FIG. 9A is another isometric view of an engagement feature on a weight plate of the resistance system of FIG. 3.

Referring now to FIGS. 5, 9A, and 9B, in a second embodiment of an engagement feature 248, a main body 304 may be provided including bores for bolting the engagement feature 248 to a weight plate. A vertically extending wall 306 may be generally centered on the width of the body 304 and may include a pair of transversely extending tabs 312 extending from the top of the wall 306. This engagement feature 248 may be configured to be engaged by a flange or second portion 146 of an engagement device 136 projecting inward toward the vertically extending wall 306. This may occur where an engagement device 136 as previously described is positioned on each side of the engagement feature 248, and a portion of the flange or second portion 146 from each engagement device 136 passes between a tab 312 and the body 304 as best shown in FIGS. 5 and 9B. Alternatively, an engagement device 136 may be provided that includes two disc shaped reaching portions 144 offset from each other by a distance, and an annularly shaped flange or second portion 146 extending inward from the perimeter of each disc, the inwardly extending flange or second portions 146 engaging the tabs 312 to lift the weight.

Referring again to FIG. 3, the carriage 110 may include a selection mechanism 140 in the form of a dial and a lever. The selection mechanism 140 may be associated with a support system 142 in the form of a shaft such that rotation of the dial causes corresponding rotation of the shaft. This may be by way of a direct connection, a geared relationship, a pulley relationship or other arrangement. Multiple engagement devices 136 may be positioned along the shaft and may be mounted on the shaft such that rotation of the shaft causes rotation of the engagement devices 136. Accordingly, when a user selects a particular weight value on the dial, the rotation of the shaft causes a particular set of engagement devices 136 to engage respective resisting elements 138. The user interface 102 may be engaged with the support system 142 via, for example, a cable connected to the shaft. As such, force in the cable may be transmitted to the shaft of the carriage 110 and in turn to the engagement devices 136 along the shaft, some of which are engaged with resisting elements 138. The connection of the user interface 102 to the shaft may be generally centered along the shaft to cause the carriage 110 to be generally balanced in the absence of an opposing force from the resisting elements 138. In some embodiments, the engagement devices 136 and resisting elements 138 may be arranged such that the load from the engaged resisting elements 138 is generally balanced about the connection point 168 to the shaft. That is, the selection of additional weight at each dial location causes selection of equal or relatively equal amounts of weight plates on either side of the connection point 168.

All directional references (e.g., upper, lower, upward, downward, left, right, leftward, rightward, top, bottom, above, below, vertical, horizontal, clockwise, and counterclockwise) are only used for identification purposes to aid the reader's understanding of the examples of the present invention, and do not create limitations, particularly as to the position, orientation, or use of the invention unless specifically set forth in the claims. Joinder references (e.g., attached, coupled, connected, joined, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. Changes in detail or structure may be made without departing from the spirit of the invention as defined in the appended claims. Accordingly the matter contained in the above description or shown in the accompanying drawings shall be interpreted as illustrative only and not limiting.

What is claimed is:

1. An engagement interface for an exercise machine for selectively engaging a carriage with one or more resisting elements, the engagement interface comprising:
- one or more engagement devices arranged on the carriage;
- an engagement feature positioned on a resisting element and configured for engagement by at least one of the one or more engagement devices, the engagement feature comprising:
  - a body attached to the resisting element;
  - at least one wall extending generally perpendicular to the body;
  - a first tab extending from the at least one wall in a first direction;
  - a second tab extending from the at least one wall in a second direction opposite the first direction; and
  - the first and second tabs configured to engage the at least one of the one or more engagement devices.

2. The engagement interface of claim 1, wherein each of the at least one of the one or more engagement devices includes a first portion, a second portion extending from the first portion, and the first portion and the second portion define at least one substantially T-shaped structure.

3. The engagement interface of claim 2, wherein the first portion is in the form of a circular disc and the second portion is in the form of an annular ring-like structure positioned on a circumferential outer edge of the disc and interrupted along the circumferential outer edge of the disc.

4. The engagement interface of claim 1, wherein the at least one wall comprises a first sidewall and a second sidewall, the first and second sidewalls disposed generally parallel to one another and defining a space therebetween, wherein a portion of the at least one of the one or more engagement devices is positioned between the first and second sidewalls.

5. The engagement interface of claim 4, wherein the first tab extends from the first sidewall towards the second sidewall, the second tab extends from the second sidewall towards the first sidewall, and the first and second tabs are generally axially aligned with each another and stop short of one another to form a gap.

6. The engagement interface of claim 5, wherein a portion of the at least one of the one or more engagement devices may be selectively positioned in the gap.

7. The engagement interface of claim 4, wherein the engagement feature further comprises a trough with a surface defined by a radius, the radius including a center point located at the center of the at least one of the one or more engagement devices, and a portion of the at least one of the one or more engagement devices may be selectively positioned between the surface of the trough and at least one of the first or second tabs.

8. The engagement interface of claim 1, wherein the one or more engagement devices comprises two engagement devices, the two engagement devices positioned adjacent to one another and configured to engage the engagement feature.

9. The engagement interface of claim 8, wherein each of the two engagement devices includes a first portion in the form of a disc, a second portion extending from the first portion, and the second portion is in the form of an annular ring-like structure positioned on the circumferential outer edge of the disc and interrupted along the circumferential outer edge of the disc.

10. The engagement interface of claim 8, wherein the at least one wall comprises a single wall generally centered on the body.

11. The engagement interface of claim 10, wherein the first and second tabs extend in opposing directions from the single wall to define a T-shaped structure.

12. The engagement interface of claim 11, wherein a portion of each of the two engagement devices may be selectively positioned between the body and at least one of the first or second tabs.

13. An exercise machine comprising:

a frame;

a resistance system including one or more resisting elements;

a carriage;

one or more engagement devices arranged on the carriage;

at least one of the one or more resisting elements including an engagement feature configured for engagement by at least one of the one or more engagement devices, the engagement feature comprising:

a body;

at least one wall extending generally perpendicular to the body;

a first tab extending from the at least one wall in a first direction;

a second tab extending from the at least one wall in a second direction opposite the first direction; and the first and second tabs configured to engage a portion of the at least one of the one or more engagement devices;

a single guide pole operatively associated with the frame and the carriage, the single guide pole and the carriage configured to guide travel of the carriage along the single guide pole; and a guide cable operatively associated with the frame and the carriage, the guide cable and the carriage configured to resist swinging of the carriage about the single guide pole.

14. The exercise machine of claim 13, further comprising a lifting element for lifting the carriage, and the carriage includes a guide pole engaging portion configured to resist tipping moment forces on the carriage from unbalanced loading about the lifting element.

15. The exercise machine of claim 14, wherein the guide pole engaging portion includes a first boss and a second boss, each boss configured to reduce friction between the guide pole engaging portion and the single guide pole.

16. The exercise machine of claim 15, wherein the first boss and the second boss are spaced from one another by approximately a length dimension of the carriage.

17. The exercise machine of claim 15, wherein the first boss and the second boss comprise bearings configured to move along the single guide pole.

18. The exercise machine of claim 17, wherein the bearings comprise ball bearing structures.

19. The exercise machine of claim 17, wherein the bearings comprise low friction material bearings.

20. The exercise machine of claim 14, wherein the guide pole engaging portion includes a boss including a length approximately the same as a length dimension of the carriage.

* * * * *